US006568021B1

(12) United States Patent
Wood

(10) Patent No.: US 6,568,021 B1
(45) Date of Patent: May 27, 2003

(54) TROWEL WITH LEVELS

(76) Inventor: George W. Wood, 1018 Sandra Pl., Brick, NJ (US) 08724

( * ) Notice: Subject to any disclaimer, the term of this patent is extended or adjusted under 35 U.S.C. 154(b) by 392 days.

(21) Appl. No.: 09/712,981

(22) Filed: Nov. 16, 2000

Related U.S. Application Data

(60) Provisional application No. 60/181,561, filed on Feb. 10, 2000.

(51) Int. Cl.[7] ..... B05C 17/10

(52) U.S. Cl. ..... 15/235.4; 33/334

(58) Field of Search ..... 15/105, 143.1, 15/235.4, 235.5, 235.6, 235.7, 235.8; 7/164; 33/334, 451

(56) References Cited

U.S. PATENT DOCUMENTS

| | | | | |
|---|---|---|---|---|
| 1,490,220 | A | | 4/1924 | Lawrence |
| 2,198,974 | A | | 4/1940 | Pilant |
| 2,771,325 | A | | 11/1956 | Brunson |
| 3,140,500 | A | | 7/1964 | Pilla |
| 3,302,233 | A | | 2/1967 | Sebastiani |
| D230,466 | S | | 2/1974 | Miller |
| D238,652 | S | | 2/1976 | Halvala et al. |
| D289,882 | S | | 5/1987 | Gringer |
| 4,703,564 | A | * | 11/1987 | Cornelius |
| D296,294 | S | | 6/1988 | Neece |
| 5,046,387 | A | | 9/1991 | Levake |
| D323,271 | S | | 1/1992 | Barenthsen |
| D376,522 | S | | 12/1996 | Tena |
| 6,178,586 | B1 | * | 1/2001 | Jafarmadar |

* cited by examiner

*Primary Examiner*—Randall E. Chin
(74) *Attorney, Agent, or Firm*—Richard C. Litman

(57) ABSTRACT

A trowel includes a series of levels embedded in the handle for measuring the inclination of a surface being finished. The trowel includes a flat base plate, with a handle having two ends each secured to the plate to define a grip area therebetween. This construction provides an extremely rigid structure, where the handle and its included levels cannot flex angularly relative to the base plate or blade. At least one of the handle ends, and optionally both ends, includes two mutually orthogonally disposed level indicators installed therein for simultaneously measuring the level or slope of a surface being worked, in two mutually perpendicular axes. The opposite handle end may also include a pair of similarly arranged levels, if so desired. The levels may comprise bubble or spirit levels, electronic levels with audible output, and/or other level types as desired.

20 Claims, 4 Drawing Sheets

TROWEL WITH LEVELS

REFERENCE TO RELATED PATENT APPLICATION

This application claims the benefit of U.S. Provisional Patent Application Ser. No. 60/181,561 filed Feb. 10, 2000.

BACKGROUND OF THE INVENTION

1. Field of the Invention

The present invention relates generally to hand tools for finishing concrete, plaster, and similar materials, and more specifically to a trowel or float which includes leveling means for measuring the inclination of the trowel and underlying surface when finishing a level or sloped floor or smoothing a sloped wall.

2. Description of Related Art

The concept of using a flat, smooth tool for finishing a hard setting material before it sets, has been known for ages. As the technology developed, different types of trowels or floats were developed in order to facilitate the operation using different materials and under different conditions for forming differently shaped structures. Heretofore, such trowels and floats have universally depended upon the skill of the user to provide a smooth and level surface, or to impart a desired slope in a floor for drainage or the like. While a skilled worker can produce reasonably accurate work under these conditions, some means of indicating the level or slope of the surface being worked, is almost always required. Accordingly, workers finishing concrete, plaster, etc. almost always resort to the use of a separate level, which is generally periodically placed across the surface in at least two directions in order to determine the level or slope of the surface.

This use of a separate level indicator, and the need to stop work to position and reposition the level as required, obviously results in additional time and expense for the worker, which is of course passed on to the end user of the structure. Accordingly, a need will be seen for a finishing trowel or float which incorporates some form of level indication means therewith, allowing the worker to quickly and easily determine the level or slope of the surface upon which he is working without need for a separate level indicator device.

A discussion of the related art of which the present inventor is aware, and its differences and distinctions from the present invention, is provided below.

U.S. Pat. No. 1,490,220 issued to William C. Lawrence on Apr. 15, 1924, titled "Bricklayer's Trowel," describes a trowel having an asymmetrical rhomboid blade with a cantilevered handle extending from the more blunt end of the blade. The handle includes a single spirit level, aligned with the elongate axes of the handle and blade. The single spirit level of the Lawrence trowel can at best indicate the level of the underlying surface in only a single direction or orientation; the Lawrence trowel must be reoriented for each direction in which it is necessary to check for level. In contrast, the present trowel or float with levels includes at least two mutually orthogonal levels, enabling the device to determine level simultaneously in two mutually perpendicular directions. Moreover, the cantilevered handle of the Lawrence trowel is prone to bending between the handle and blade, thus making the Lawrence level inaccurate. This cannot happen with the present trowel and levels, as the handle extends across the center of the blade and is secured at each end of the handle to the blade. In addition, the present trowel and levels also provides for electronic leveling means, which may produce an audible signal so the worker need not divert his visual attention to the level displays themselves.

U.S. Pat. No. 2,198,974 issued to Charles D. Pilant on Apr. 30, 1940, titled "Plasterer's Float," describes a float or trowel with an arched handle secured across the float blade or plate. The blade is symmetrically tapered in planform from its center, and includes a slight upward angle to each blade half from a lateral centerline and an upwardly turned outer edge or fence along each edge. The Pilant trowel or float is intended to reduce the tendency for the device to cut or plow into the still plastic surface of uncured plaster or other material being worked. No leveling instrument or means is provided by Pilant for his float or trowel.

U.S. Pat. No. 2,771,325 issued to Leigh S. Brunson on Nov. 20, 1956, titled "Cement Mason's Float," describes a trowel or float wherein the plate or blade portion is formed of extruded magnesium material. A central rib or spine is formed along the plate, with sockets machined therein for accepting the ends of a removable handle attachment. The general configuration only superficially resembles that of the present invention, and in any event, the Brunson float has no provision whatsoever for any level indication means therewith, as provided by the present trowel with levels invention.

U.S. Pat. No. 3,140,500 issued to Anthony Pilla on Jul. 14, 1964, titled "Floats For Spreading Concrete Or The Like," describes a float having an arched handle secured to the float blade or plate by screws. The blade or plate is formed of an acrylic plastic material, with the bottom surface thereof being finished in a regular pattern of rhomboid, circular, or elliptical geometric shapes. A generally U-shaped handle is secured to the upper surface of the plate by screws which pass through the plate. The resulting configuration is generally conventional, with no level indication means being provided with the Pilla trowel or float.

U.S. Pat. No. 3,302,233 issued to Martin Sebastiani on Feb. 7, 1967, titled "Mortar Dressing Device," describes a wedge shaped tool having a hollow core. The tool has no handle means, but may include a pair of mutually orthogonal bubble or spirit levels set into open windows or passages through the blade body. The placement of the levels in the blade body itself, greatly increases the chances of the levels becoming covered with mortar, plaster, or other material during the working process. In contrast, the present trowel with levels places the level indicator means in the handle, well away from the trowel blade or plate portion of the tool, to protect the levels from contamination or impact with other objects.

U.S. Pat. No. 5,046,387 issued to Rodney D. Levake on Sep. 10, 1991, titled "Stabilized, Multifunctional Tool Handle," describes a large number of embodiments of various tool handles, some of which include level indicators therein. Levake also discloses plasterer's floats or darbys with handles, each of which incorporate a single spirit level therein. The drawbacks of having a single level indicator in the handle of such a device, were noted further above in the discussion of the '220 U.S. Patent to Lawrence. In contrast, the present trowel with levels incorporates at least two mutually orthogonal levels in the handle thereof, so the user may quickly and easily determine the level or slope being worked, simultaneously in two mutually perpendicular axes.

U.S. Pat. No. D-230,466 issued to Maurice H. Miller on Feb. 26, 1974, titled "Wall Washing Trowel," illustrates a design for a trowel which incorporates a nozzle and controls for pressure washing. No level indicating means is apparent in the Miller trowel design.

U.S. Pat. No. D-238,652 issued to William S. Halvala et al. on Feb. 3, 1976, titled "Concrete Finishing Tool," illustrates a design for a trowel having a handle attached at two points to the underlying blade or plate. No level indicator means is apparent.

U.S. Pat. No. D-289,882 issued to Donald Gringer on May 19, 1987, titled "Trowel," illustrates a design for a trowel with an open handle secured to the underlying blade or plate. No leveling means is apparent in the Gringer design.

U.S. Pat. No. D-296,294 issued to Roy M. Neece on Jun. 21, 1988, titled "Concrete Trowel," illustrates a design for a trowel with an open ended handle secured to the blade or plate. The handle is grooved or inset along the sides thereof, but no leveling means is apparent in any component of the Neece design.

U.S. Pat. No. D-323,271 issued to Roger S. Barenthsen on Jan. 21, 1992, titled "Adjustable Trowel," illustrates a design for a trowel which blade includes a live hinge along the centerline thereof. Two arcuate arms extend from each blade portion, with a handle extending between the arms at each end. The arms may be adjusted to adjust the angle between the two blade portions, along the live hinge. No level indication means is apparent in the '271 Barenthsen Design Patent.

Finally, U.S. Pat. No. D-376,522 issued to Rudy D. Tena on Dec. 17, 1996, titled "Trowel," illustrates a design wherein the blade includes an elongate rectangular ridge along the back thereof. The handle extends upwardly from the ridge. No level indication means is apparent in the Tena Design Patent.

An ideal trowel would include at least two mutually orthogonal level indicators (spirit or bubble levels, electronic levels, etc.) which could measure the exact inclination of a floor or wall. For example, the floor of a shower may include a shallow conical depression that leads to a centrally located drain at the lowest point of the floor. A trowel capable of measuring the inclinations both parallel and perpendicular to the orientation of the handle of the trowel would accomplish this type of masonry work without need for a separate level indicating tool, where other types of trowels require the use of such a separate level.

None of the above inventions and patents, taken either singly or in combination, is seen to describe the instant invention as claimed.

SUMMARY OF THE INVENTION

The present invention is a trowel or float with a series of level indicators embedded in the handle for indicating the inclination of a floor being floated and finished. The trowel or float handle secures to the underlying blade or plate at both ends thereof, to form a rigid construction precluding relative movement of the handle relative to the base. The handle preferably includes at least two level indicators (i. e., spirit or bubble level, or electronic level means, etc.) therein, with the two levels being oriented orthogonally to one another for simultaneously indicating the level or slope of the underlying surface in two mutually orthogonal axes. One end of the handle may have a single level with the opposite end having a second level perpendicular to the first level, or each handle end may include a pair of mutually orthogonally oriented levels, as desired.

Accordingly, it is a principal object of the invention to provide a trowel with a plurality of level indicator means for precisely indicating the inclination of a surface as it is formed.

It is another object of the invention to provide a leveling trowel which handle portion is secured to the base plate at two opposite ends, to provide a rigid structure in which the handle is immovable relative to the base plate or blade.

It is a further object of the invention to provide a leveling trowel which handle includes at least two mutually orthogonally disposed level indicators at one end of the handle thereof.

Still another object of the invention is to provide a leveling trowel which may include a pair of mutually orthogonally disposed level indicators at each end of the handle, in a second embodiment.

Yet another object of the invention is to provide a leveling trowel which leveling means may comprise bubble or spirit levels, electronic levels with audible output, or a combination thereof.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention comprises a concrete or plastering trowel or float, including a series of level indicators disposed within the handle of the device. The present trowel and levels allows a worker to quickly and easily determine the slope of the surface being finished, simultaneously in two mutually perpendicular axes. Thus, the present trowel with levels allows a worker to dispense with the need for separate leveling tools and equipment, thereby saving time and expenses in such work.

Figure 1:
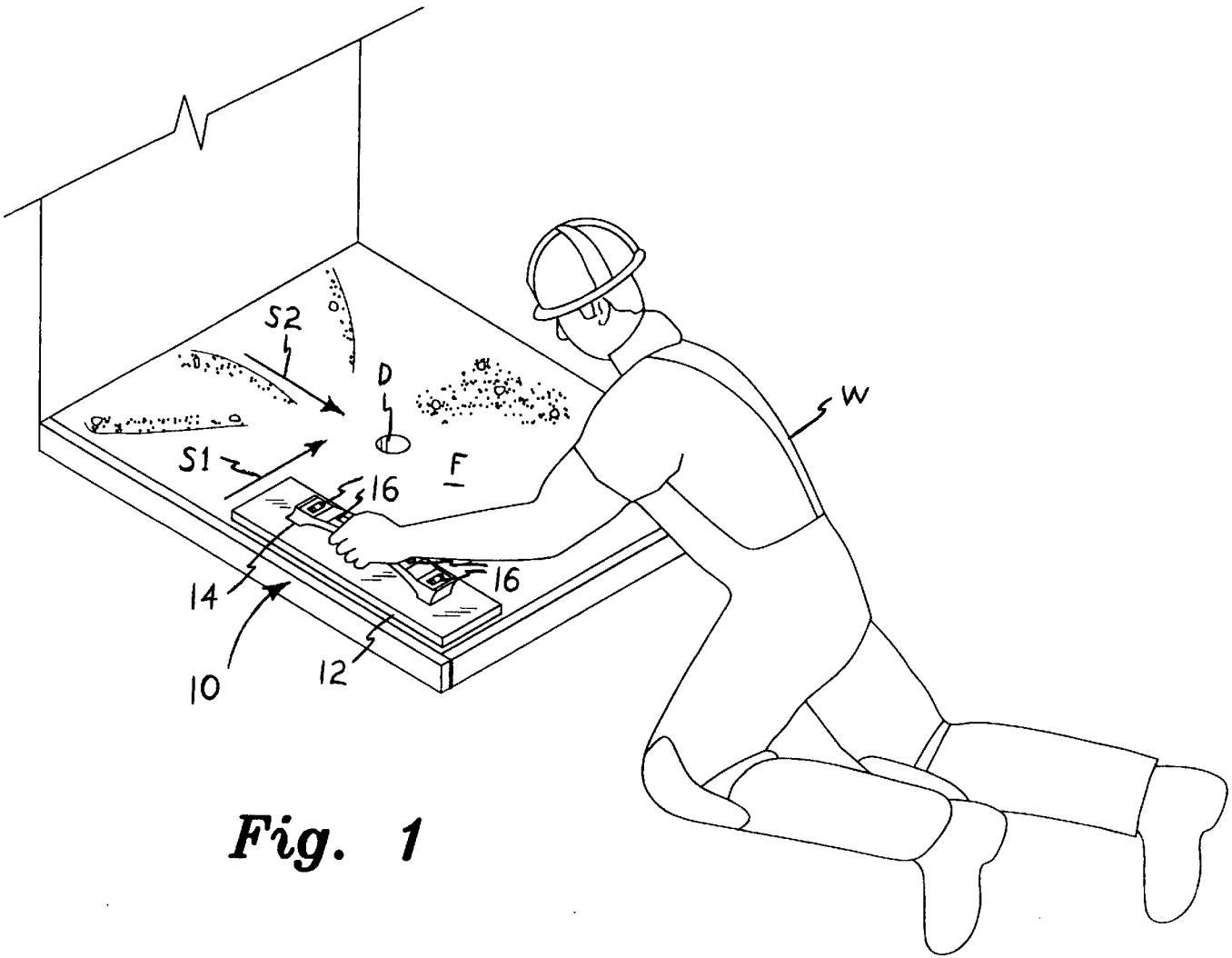
FIG. 1 is an environmental perspective view of the trowel and levels according to the present invention, showing its use in finishing a sloped surface.
Figure 4:
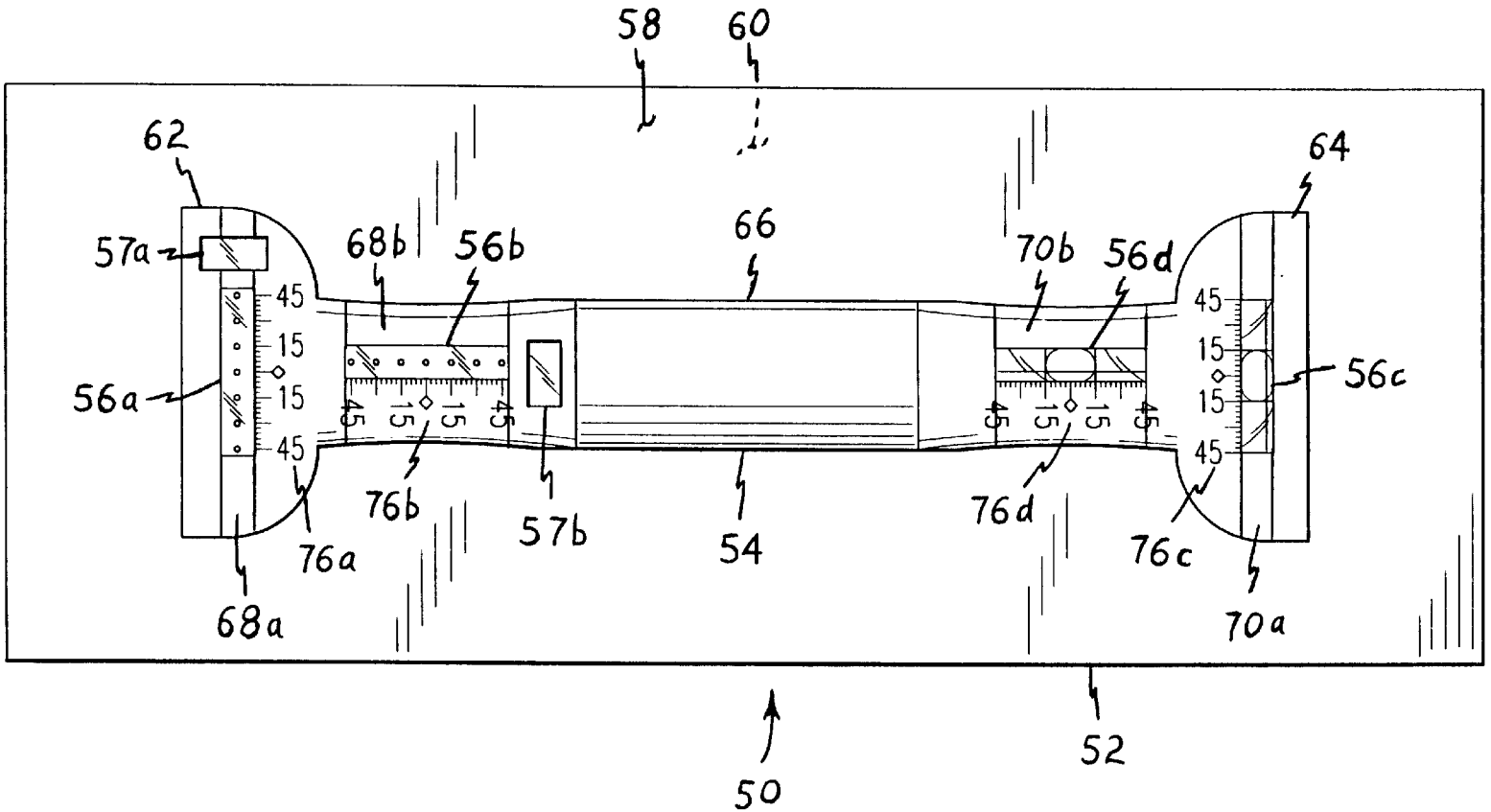
FIG. 4 is a top plan view of an alternative embodiment of the present trowel and levels, wherein a pair of mutually orthogonal electronic leveling devices are provided at one end of the handle.

FIG. 1 provides an environmental perspective view of a first embodiment of the present trowel with levels 10 in use, showing its application in finishing the sloping floor F of a shower facility. The trowel 10 essentially comprises a base plate or blade 12 with a handle 14 affixed to the upper surface of the plate 12. The handle 14 has two opposed attachment ends, each of which are affixed to the plate 12 of the trowel 10. At least one (and preferably both) of these attachment ends of the handle 14 include some form of level indicator means installed therein, e. g. spirit or bubble levels 16, or electronic levels as illustrated in the embodiment of FIG. 4 and discussed further below, etc.

Figure 2:
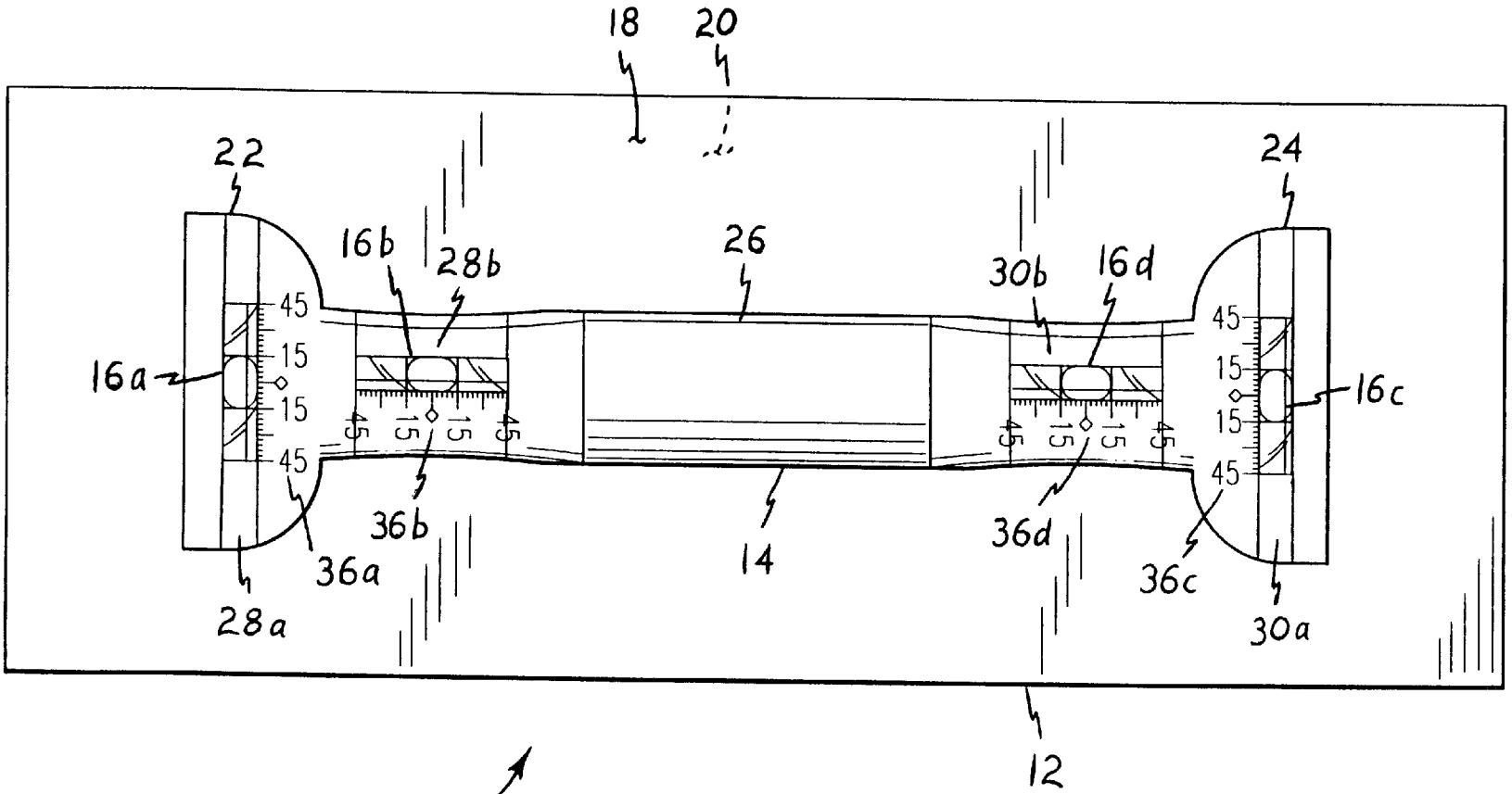
FIG. 2 is a top plan view of the leveling trowel illustrated in FIG. 1, drawn to an enlarged scale, and showing a series of bubble or spirit levels and measuring scales therewith.
Figure 3:
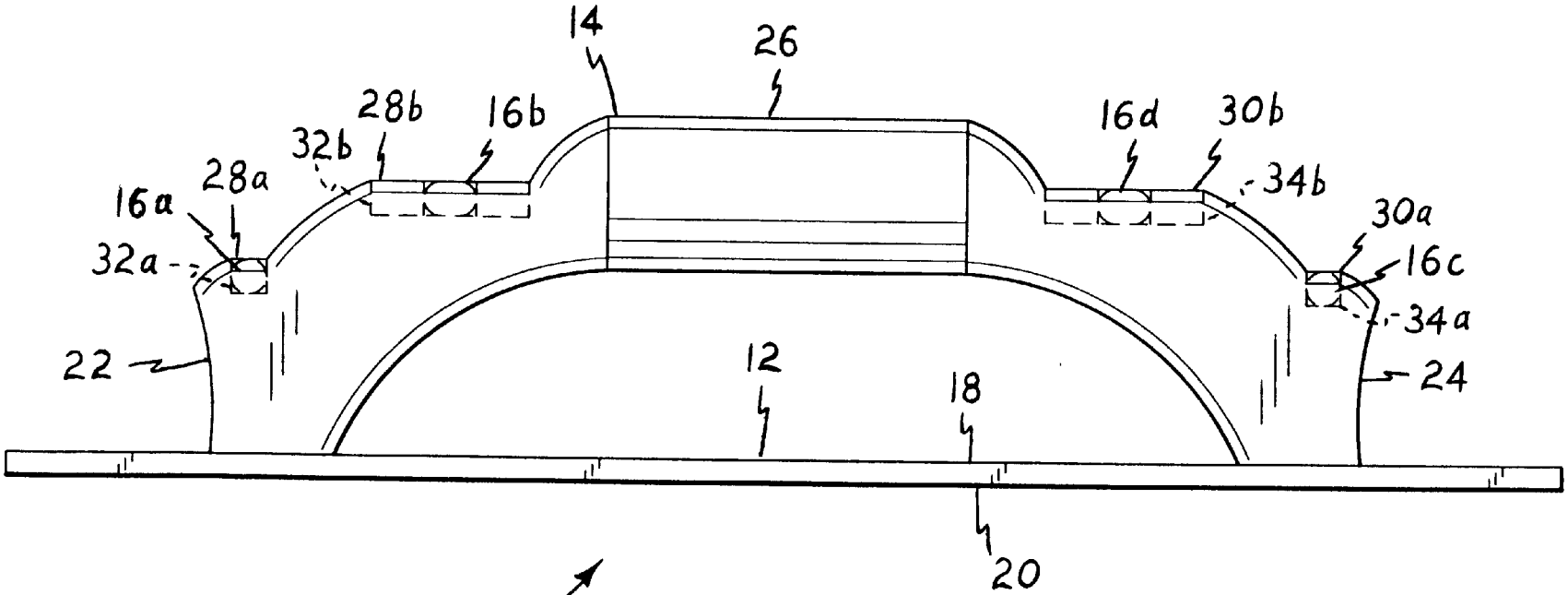
FIG. 3 is a side elevation view of the trowel of FIG. 2.

FIGS. 2 and 3 of the drawings respectively provide detailed top plan and side elevation views of the first embodiment of the present trowel with levels 10 shown in use in FIG. 1. The base plate or blade 12 of the trowel 10 comprises a relatively rigid, flat structure having an upper surface 18 and opposite flat lower surface 20, adapted for smoothing and finishing a plastic surface (e. g., concrete, plaster, etc.) before it hardens and cures. The solid handle 14 has a first plate attachment end 22, an opposite second plate attachment end 24, and a central hand grip area 26 between the two attachment ends 22 and 24. The attachment ends 22 and 24 provide means for conventionally attaching the handle 14 rigidly and immovably to the base plate 12, e. g., conventional threaded fasteners, rivets, spot welds for metal components, etc. as desired. The rigid and immovable attachment of the handle 14 to the underlying plate 12, precludes movement of the handle 14 and level indicators 16 thereon relative to the base plate 12, to provide accurate indications of the level or slope of the surface underlying the plate 12.

The levels 16 reside in level indicator shelves or flats formed in each end 22 and 24 of the handle 14 and adjacent the plate 12, or at least in a handle end containing such level indicators. In FIGS. 2 and 3, the first handle end 22 includes a lateral level shelf 28*a*, with a longitudinally disposed level shelf 28*b* positioned between the lateral shelf 28*a*and the handgrip portion 26 of the handle 14. The opposite second end 24 is configured in a mirror image, with a lateral level shelf 30*a* over the extremity of the second end 24 and a longitudinal level shelf 30*b* between the second end lateral shelf 30*a* and the handgrip portion 26 of the handle 14.

Each of the level indicator shelves or surfaces 28*a* through 30*b* comprises a flat, level surface parallel to the bottom surface 20 of the plate or blade 12. The first end indicator shelves 28*a* and 28*b* and second end indicator shelves 30*a* and 30*b*, comprise first and second pairs of shelves with each shelf of a pair being mutually orthogonal to one another, i. e., each first shelf 28*a* and 30*a* is oriented parallel to the minor axis of the rectangular plate 12, with each second shelf 28*b* and 30*b* being oriented parallel to the major axis of the plate 12, as shown in the top plan view of FIG. 3 of the drawings.

These shelves 28*a* through 30*b* each contain a corresponding, level indicator recess or receptacle 32*a* through 34*b* formed therein for securing a spirit or bubble level therein, with the recesses 32*a*, 32*b* and 34*a*, 34*b* of each level shelf pair 28*a*, 28*b* and 30*a*, 30*b* being mutually orthogonal to one another, i. e., having the same orientation as their respective level shelves or surfaces. The levels are secured within the receptacles 32*a* through 34*b* to lie parallel to the surfaces of the shelves 28*a* through 30*b* and the bottom surface 20 of the plate 12, with the receptacles 32*a*, 32*b* of the first, handle end shelf pair 28*a*, 28*b* containing a mutually orthogonal first spirit level pair 16*a*, 16*b*, and the receptacles 34*a*, 34*b* of the second handle end shelf pair 30*a*, 30*b* containing a mutually orthogonal second spirit level pair 16*c*, 16*d*. It will be seen that other combinations of level indicator installations may be provided as desired, e. g., a single level at one handle end with another single level at the opposite handle end, with both levels having mutually perpendicular axes, or only a single level pair at one handle end, etc.

In order to provide an accurate indication of the slope of the underlying surface upon which the present trowel and levels 10 is placed, a series of slope indicator scales, respectively 36*a* through 36*d*, may be placed adjacent their corresponding level vials 16*a* through 16*d* as shown in FIG. 2. These scales 36*a* through 36*d* are preferably calibrated in angular degrees, but other calibration factors (e.g., the "fall" of the slope or unit of vertical distance per unit of horizontal distance, etc.) may be provided as desired.

FIG. 4 illustrates a top plan view of an alternate but closely related embodiment, in which a trowel with levels 50 includes electronic level indicator means therewith. The trowel, and levels 50 of FIG. 4 is generally configured like the trowel and levels 10 of FIGS. 1 through 3, comprising a base plate or, blade 52 with a handle 54 affixed to the upper surface of the plate 52. The handle 54 has two opposed attachment ends, each of which are affixed to the plate 52 of the trowel 50. The base plate or blade 52 has an upper surface 58 and opposite flat lower surface 60. The solid handle 54 has a first plate attachment end 62, an opposite second plate attachment end 64, and a central hand grip area 66 between the two attachment ends 62 and 64.

As in the trowel and level 10 of FIGS. 1 through 3, each handle end 62 and 64 of the trowel and level 50 of FIG. 4 includes at least one level shelf area, and preferably two mutually orthogonal such areas, respectively 68*a*, 68*b* at the first handle end 62 and 70*a*, 70*b* at the second handle end 64. These shelves 68*a* through 70*b* each contain a corresponding level indicator recess or receptacle (not shown, but essentially identical to the recesses 32*a* through 34*b* of the level shelves 28*a* through 30*b* of the trowel and level 10) formed therein for securing a level therein, with the recesses of each level shelf pair 68*a*, 68*b* and 70*a*, 70*b* being mutually orthogonal to one another, i. e., having the same orientation as their respective level shelves or surfaces. The levels are secured within the receptacles to lie parallel to the surfaces of the shelves 68*a* through 70*b* and the bottom surface 60 of the plate 52, with the receptacles of the first handle end shelf pair 68*a*, 68*b* containing a mutually orthogonal first level pair 56*a*, 56*b*, and the receptacles of the second handle end shelf pair 70*a*, 70*b* containing a mutually orthogonal second level pair 56*c*, 56*d*.

The trowel and levels 50 of FIG. 4 differs from the trowel and levels 10 of FIGS. 1 through 3, in that the trowel and level 50 includes electronic level indicator means rather than solely spirit or bubble level indicators In the example of FIG. 4, the two first handle end levels 56*a* and 56*b* are electronic, comprising a series of light emitting-diodes (LEDs) or other level indicator means, as is conventional in such electronic levels. A supplemental display window, respectively 57*a* and 57*b*, may also be provided to show a precise angular slope in a digital readout. Such electronic leveling means 56*a*, 56*b* may also include conventional audible output (not shown, but known in the art) to alert the worker when the desired slope is attained or exceeded.

The opposite second handle end 64 includes a mutually orthogonal pair of conventional spirit or bubble levels, respectively 56*c* and 56*d*. It will be seen that other combinations of level indicator installations may be provided as desired, e. g., electronic level indicators at all level positions, a single electronic or spirit level at one handle end with another single electronic or spirit level at the opposite handle end, with both levels having mutually perpendicular axes, or only a single electronic or spirit level pair at one handle end, etc.

As in the case of the trowel and level 10 of FIGS. 1 through 3, a series of slope indicator scales, respectively 76*a* through 76*d*, may be placed adjacent their corresponding levels 56*a* through 56*d* as shown in FIG. 4. These scales 76*a* through 76*d* are preferably calibrated in angular degrees, but other calibration factors (e.g., the "fall" of the slope or unit of vertical distance per unit of horizontal distance, etc.) may be provided as desired.

The various embodiments of the present trowel with levels invention are used generally as depicted in FIG. 1 of the drawings, with a worker W smoothing and finishing the slight conical slope of the shower floor F, downwardly toward the drain D. The present trowel with levels enables the worker W to determine the slope of the floor F in two mutually orthogonal axes S1 and S2 simultaneously, due to the integral provision of the mutually orthogonal level indicators 16*a*, 16*b* and/or 16*c*, 16*d*, and/or the electronic leveling means 56*a*, 56*b* of the trowel and levels 50 illustrated in FIG. 4. The result is a significant saving in time and labor, as well as expense for the worker W, who no longer requires a separate level to indicate such slopes. The present trowel and level embodiments will also prove useful in other forms of construction as well, such as smoothing and finishing concrete steps, stoops, and porches, where some slight but uniform slope is desired for water runoff. Accordingly, the present trowel and levels invention will prove to be a much desired and nearly indispensable tool for those who engage in the craft of finishing concrete, plaster, and similar materials.

It is to be understood that the present invention is not limited to the embodiments described above, but encompasses any and all embodiments within the scope of the following claims.

I claim:

1. A trowel with levels, comprising:

a base plate having an upper surface and a flat lower surface opposite said upper surface;

a solid handle rigidly and immovably attached to and extending from said upper surface of said base plate;

said handle having a first plate attachment end, a second plate attachment end opposite said first end, and a central hand grip portion disposed between each said end;

at least one said end of said handle further including level indicator shelf means adjacent said plate;

said level indicator shelf means having an upper surface parallel to said lower surface of said base plate;

said level indicator shelf means further having a pair of level indicator recesses formed therein, with said level indicator recesses being oriented mutually orthogonally with respect to one another; and a plurality of level indicators, with each of said indicators installed within one of said level indicator recesses of said handle and oriented mutually orthogonally with respect to one another for simultaneously measuring slope along two mutually perpendicular axes.

2. The trowel according to claim 1, further including a slope indication scale disposed at each of said level indicators.

3. The trowel according to claim 1, wherein said level indicators comprise spirit levels.

4. The trowel according to claim 1, wherein said level indicators comprise electronic levels.

5. The trowel according to claim 1, further including audible level signaling means.

6. A trowel with levels, comprising:

a base plate having an upper surface and a flat lower surface opposite said upper surface;

a solid handle rigidly and immovably attached to and extending from said upper surface of said base plate;

said handle having a first plate attachment end, a second plate attachment end opposite said first end, and a central hand grip portion disposed between each said end;

each said end of said handle further including level indicator shelf means adjacent said plate;

said level indicator shelf means having an upper surface parallel to said lower surface of said base plate;

said level indicator shelf means further having a first and a second level indicator recess formed therein, with said first and said second level indicator recess being oriented mutually orthogonally with respect to one another; and a plurality of first and second level indicators, with each of said indicators installed within one of said level indicator recesses of each said level indicator shelf means of said handle and with said first and said second indicators oriented mutually orthogonally with respect to one another for simultaneously measuring slope along two mutually perpendicular axes.

7. The trowel according to claim 6, further including a slope indication scale disposed at each of said level indicators.

8. The trowel according to claim 6, wherein said level indicators are selected from the group consisting of spirit levels and electronic levels.

9. The trowel according to claim 8, further including audible level signaling means for said electronic levels.

10. The trowel according to claim 6, wherein said level indicators of said level indicator shelf means of said first handle attachment end comprise spirit levels.

11. The trowel according to claim 6, wherein said level indicators of said level indicator shelf means of said second handle attachment end comprise electronic levels.

12. The trowel according to claim 11, further including audible level signaling means.

13. A trowel with levels, comprising:

a base plate having an upper surface and a flat lower surface opposite said upper surface;

a solid handle rigidly and immovably attached to and extending from said upper surface of said base plate;

said handle having a first plate attachment end, a second plate attachment end opposite said first end, and a central hand grip portion disposed between each said end;

a first pair of indicators installed within said first plate attachment end of said handle, with each of said first pair of indicators being oriented mutually orthogonally with respect to one another for simultaneously measuring slope along two mutually perpendicular axes; and a second pair of indicators installed within said second plate attachment end of said handle, with each of said second pair of indicators being oriented mutually orthogonally with respect to one another for simultaneously measuring slope along two mutually perpendicular axes.

14. The trowel according to claim 13, further including:

level indicator shelf means adjacent said plate at each said end of said handle;

said level indicator shelf means having an upper surface parallel to said lower surface of said base plate;

said indicator shelf means further having a first and a second level indicator recess formed therein, with said first and said second level indicator recess being oriented mutually orthogonally with respect to one another; and one of said indicators being installed within a corresponding one of said level indicator recesses of said indicator shelf means of said handle.

15. The trowel according to claim 13, further including a slope indication scale disposed at each of said level indicators.

16. The trowel according to claim 13, wherein said level indicators are selected from the group consisting of spirit levels and electronic levels.

17. The trowel according to claim 13, further including audible level signaling means for said electronic levels.

18. The trowel according to claim 13, wherein said level indicators of said level indicator shelf means of said first handle attachment end comprise spirit levels.

19. The trowel according to claim 13, wherein said level indicators of said level indicator shelf means of said second handle attachment end comprise electronic levels.

20. The trowel according to claim 19, further including audible level signaling means.

* * * * *